US008528537B2

(12) United States Patent
Chilton et al.

(10) Patent No.: US 8,528,537 B2
(45) Date of Patent: Sep. 10, 2013

(54) COMBUSTION AND COOLING AIRFLOW SYSTEM FOR A COOKING APPLIANCE

(75) Inventors: John Mark Chilton, Campbellsburg, KY (US); Michael Thomas Chezem, Georgetown, IN (US); Philip A. Barber, Louisville, KY (US); Gerardo Picon, Queretaro (MX)

(73) Assignee: General Electric Company, Schenectady, NY (US)

( * ) Notice: Subject to any disclaimer, the term of this patent is extended or adjusted under 35 U.S.C. 154(b) by 486 days.

(21) Appl. No.: 12/854,678

(22) Filed: Aug. 11, 2010

(65) Prior Publication Data

US 2012/0037142 A1 Feb. 16, 2012

(51) Int. Cl.

| | |
|---|---|
| ***A21B 1/00*** | (2006.01) |
| ***A21B 1/08*** | (2006.01) |
| ***F24C 15/00*** | (2006.01) |
| ***F24C 15/08*** | (2006.01) |
| ***F24C 15/16*** | (2006.01) |
| ***F24C 15/32*** | (2006.01) |
| ***A47J 37/07*** | (2006.01) |

(52) U.S. Cl.
USPC ..... 126/21 R; 126/15 R; 126/19 R; 126/20.1

(58) Field of Classification Search
USPC ..... 126/21 R, 20.1, 22, 21 A, 19 R, 190, 126/198, 193, 15 R, 15 A, 37 R; 219/394
See application file for complete search history.

(56) References Cited

U.S. PATENT DOCUMENTS

| | | | | |
|---|---|---|---|---|
| 4,375,213 | A * | 3/1983 | Kemp et al. | 126/21 A |
| 4,796,600 | A * | 1/1989 | Hurley et al. | 126/21 R |
| 6,758,206 | B1 * | 7/2004 | Barnes et al. | 126/21 R |

* cited by examiner

*Primary Examiner* — Kenneth Rinehart
*Assistant Examiner* — Tavia Sullens
(74) *Attorney, Agent, or Firm* — Global Patent Operation; Douglas D. Zhang

(57) ABSTRACT

A cooking appliance has a cabinet including a front portion, opposing side panels, a base portion, a back panel and a top surface. First and second oven cavities are disposed within the cabinet. Each of the first and second oven cavities include respective sidewall portions maintained in a spaced apart relationship from the opposing side panels. A first airflow passageway provides combustion air to the first oven cavity and cooling air within the cabinet and a second airflow passageway provides combustion air to the lower cavity. The second airflow passageway is separated from the first airflow passageway.

15 Claims, 7 Drawing Sheets

COMBUSTION AND COOLING AIRFLOW SYSTEM FOR A COOKING APPLIANCE

BACKGROUND OF THE INVENTION

The present disclosure generally relates to cooking appliances, and more particularly to a combustion and cooling airflow system for a gas double oven.

In a gas oven product, it is important to be able to provide adequate air to the cavities for the gas burners to improve burner performance and pass combustions. For a gas burner to function efficiently, a sufficient amount of air must be available to fully combust the gas emitted from the burner. Similarly, adequate cooling air must be provided for heat management and maintaining acceptable temperatures on installation surfaces and components.

In a dual range or double oven product, this becomes a large technical challenge. Adequate airflow is required for each of the upper combustion, lower combustion and cooling pathways. Some efforts to address the combustion and cooling airflow issues utilize a single airflow path that feeds all three of the airflow requirements in a double oven.

Accordingly, it would be desirable to provide a system that addresses at least some of the problems identified.

BRIEF DESCRIPTION OF THE INVENTION

As described herein, the exemplary embodiments overcome one or more of the above or other disadvantages known in the art.

One aspect of the exemplary embodiments relates to a cooking appliance. In one embodiment, the cooking appliance includes a cabinet that has a front portion, opposing side panels, a base portion, a back panel and a top surface. First and second oven cavities are disposed within the cabinet. Each of the first and second oven cavities include respective sidewall portions maintained in a spaced apart relationship from the opposing side panels. A first airflow passageway provides combustion air to the first oven cavity and cooling air within the cabinet and a second airflow passageway provides combustion air to the second oven cavity. The second airflow passageway is separated from the first airflow passageway.

In another aspect, the exemplary embodiments relate to a cooking appliance. In one embodiment, the cooking appliance includes a cabinet that has a front portion, opposing side panels, a base portion, a back panel and a top surface. First and second oven cavities are disposed within the cabinet. Each of the first and second oven cavities include respective sidewall portions maintained in a spaced apart relationship from the opposing side panels. A first passageway is defined between each opposing side panel and the respective sidewall portions of the first and second oven cavities. A second passageway is defined between the base portion and a bottom surface of the second oven cavity. A barrier member separates the second passageway from the first passageway.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
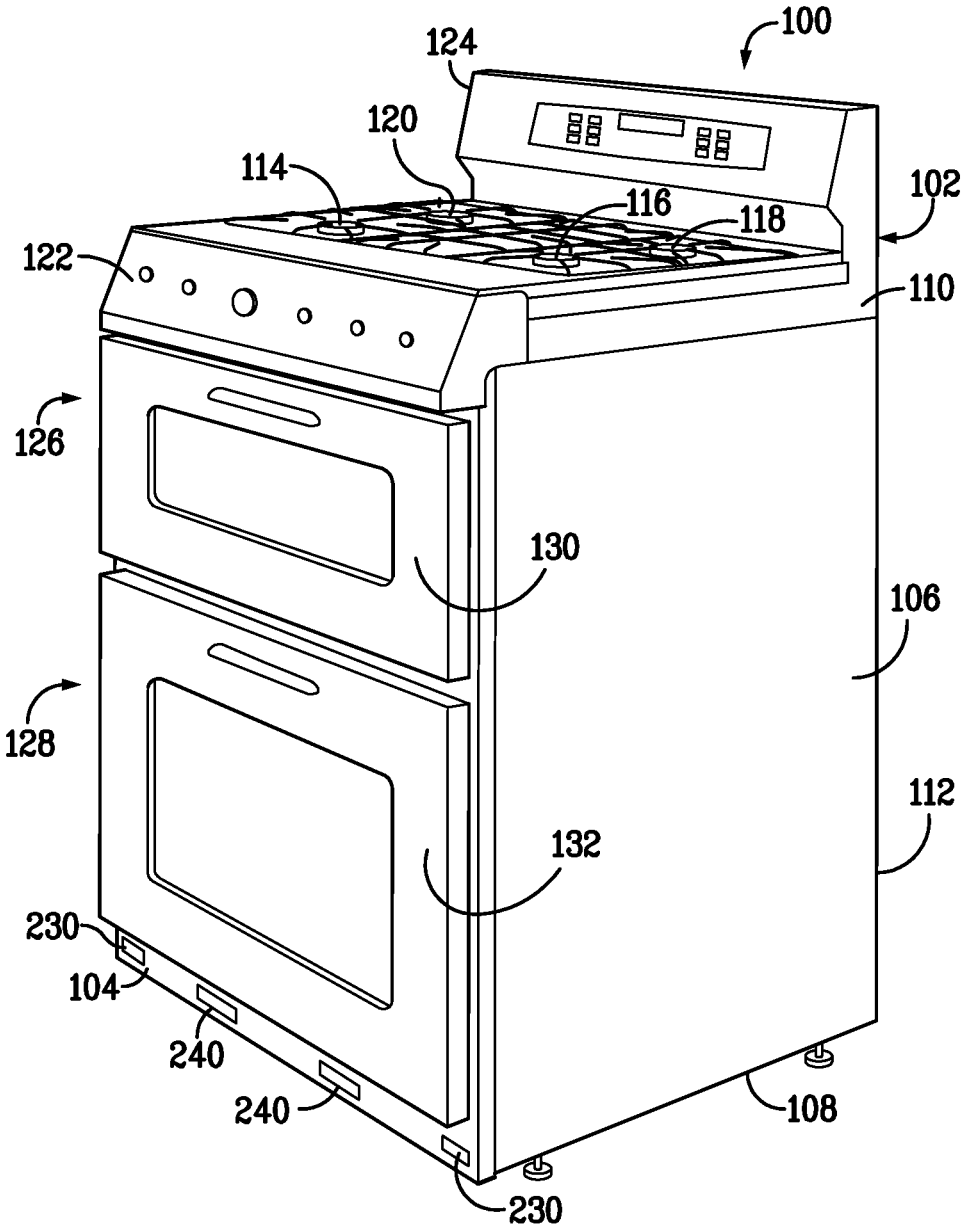
FIG. 1 is a perspective view of an exemplary cooking appliance incorporating aspects of the disclosed embodiments.

Referring to FIG. 1, an exemplary cooking appliance, such as a dual-cavity or double gas oven, incorporating aspects of the disclosed embodiments, is generally designated by reference numeral 100. The aspects of the disclosed embodiments are directed to improving the combustion and cooling airflow to a dual-cavity gas oven by isolating the lower oven combustion air from the upper oven combustion air and the cooling air. Two separate air inlet slots create two airflow pathways. A barrier member between the air inlet slots and the passageways inside the structure isolates the two airflow paths.

As is shown in FIG. 1, the oven 100 is generally in the form of a free-standing gas range or oven. The oven 100 includes a cabinet or housing 102 that has a front portion 104, opposing side panels 106, a base portion 108, a top portion 110, and a back panel 112.

In the embodiment shown in FIG. 1, the top portion 110 of the oven 100 includes gas burner elements 114, 116, 118 and 120. Although the oven 100 is shown with four gas burner elements 114-120, in other embodiments, the oven 100 can have any number of gas burner elements. The oven 100 also includes an upper oven 126 and a lower oven 128. The upper oven 126 has a door 130, while the lower oven has door 132. Each door 130, 132 can be pivoted between an open and closed position in a manner generally known.

The cabinet 102 also includes a control surface 122 that supports control knobs, or other suitable control switches for regulating the gas burner elements 114, 116, 118 and 120. The cabinet 102 also includes a control panel 124 that includes a central control and display unit. One aspect of the control panel 124 is to control the operation of the upper and lower ovens 126, 128, including the ignition and temperature settings.

Figure 2:
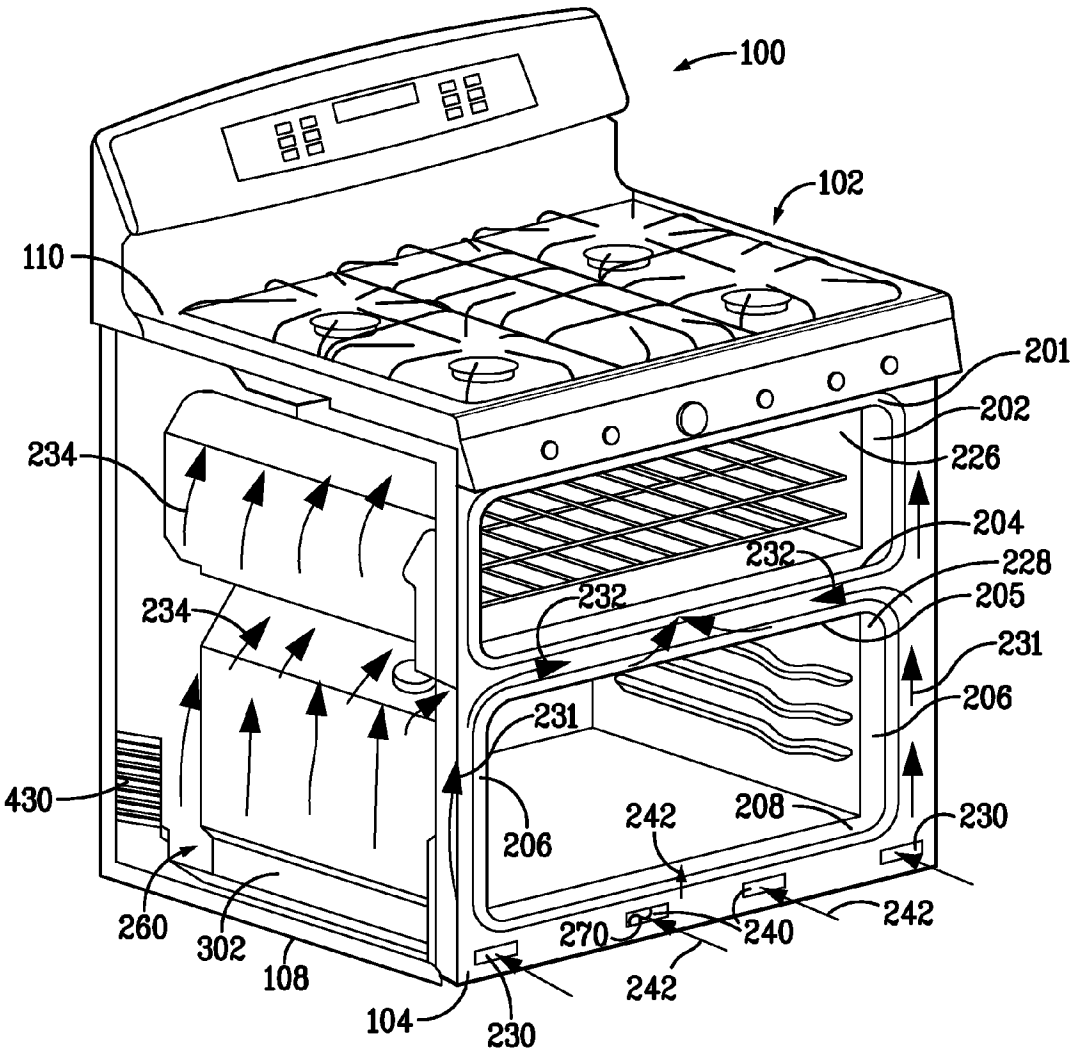
FIG. 2 is a perspective view of the cooking appliance of FIG. 1 with the oven doors and the side panels removed.
Figure 5:
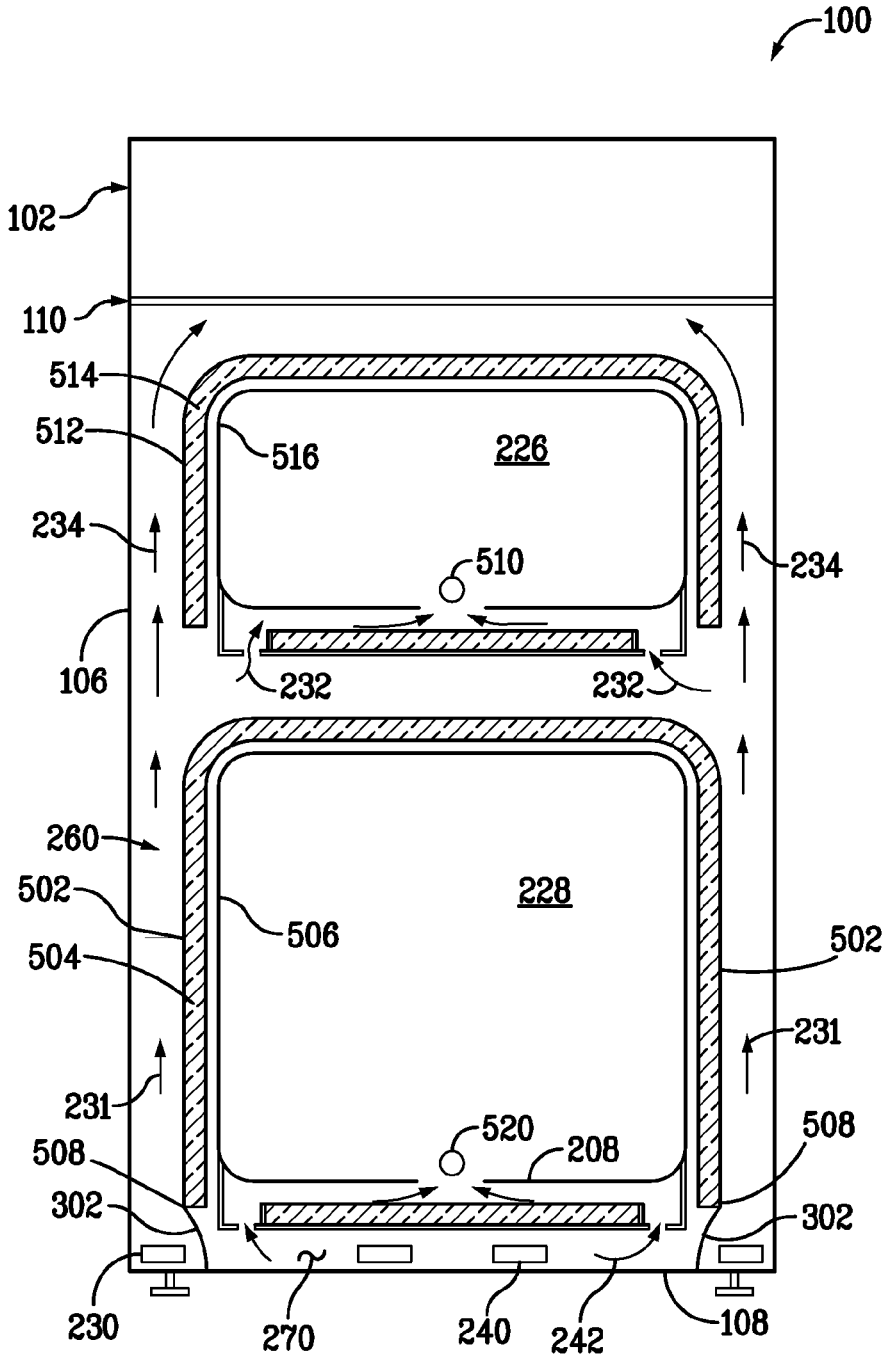
FIG. 5 is a rear, cross-sectional view of one embodiment of the cooking appliance of FIG. 1.

Referring to FIG. 2, the upper oven 126 includes a first or upper oven cavity 226, and the lower oven 128 includes a second or lower cavity 228. The upper cavity 226 includes a top portion 201, side walls 202 and a bottom portion 204. The lower cavity 228 includes a top portion 205, side walls 206 and a bottom portion 208. As is shown in FIG. 5, each of the upper and lower cavities 226, 228 can also include a respective burner assembly 510, 520. Each of the burner assemblies 510, 520 must be provided with an adequate supply of combustion air in order to properly operate the oven 100. Although only a single burner assembly is shown in each of the upper and lower cavities 226, 228, in alternate embodiments, any suitable number of burner assemblies can be provided. For example, in one embodiment, the upper cavity 226 could include an upper, broil burner assembly and a lower, bake burner assembly, while the lower cavity 228 includes a lower, bake burner assembly. In alternate embodiments, any suitable combination of burner assemblies can be used in each of the upper and lower oven cavities 226, 228.

Additionally, a supply of cooling air must be provided to maintain the external temperatures of the cabinet 102 at acceptable levels. In ordinary gas double oven configurations, air is drawn in from vents along the bottom front portion of the oven and passed through ducts or passageways that are formed between the top and sidewalls of the oven cabinet and the outer sides of the oven cavities. However, in these products, a single supply of air is used for providing both the combustion air to each of the oven cavities and the cooling air. The aspects of the disclosed embodiments isolate the airflow paths within the cabinet 102 to provide two separate airflow paths. One airflow path provides combustion air to the lower cavity and another airflow path provides combustion air to the upper cavity as well as the cooling air within the cabinet.

Figure 3:
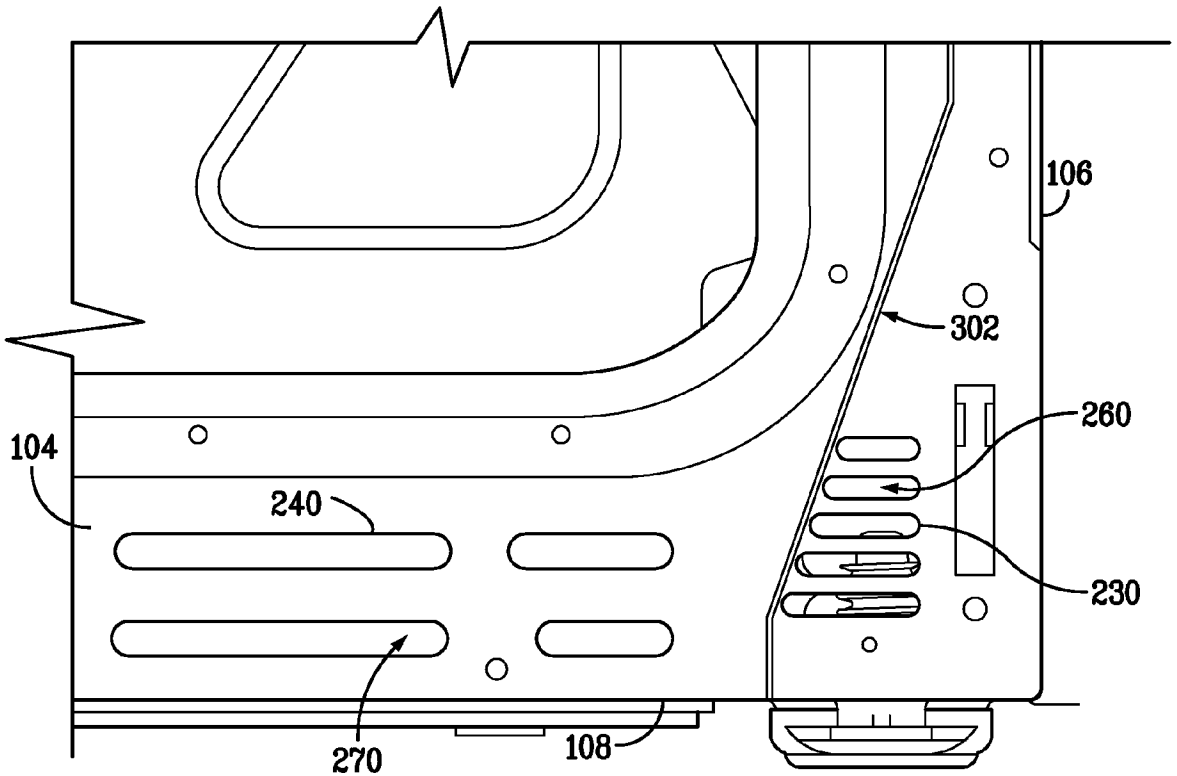
FIG. 3 illustrates a front view of an air inlet structure for a cooking appliance incorporating aspects of the disclosed embodiments.
Figure 4:
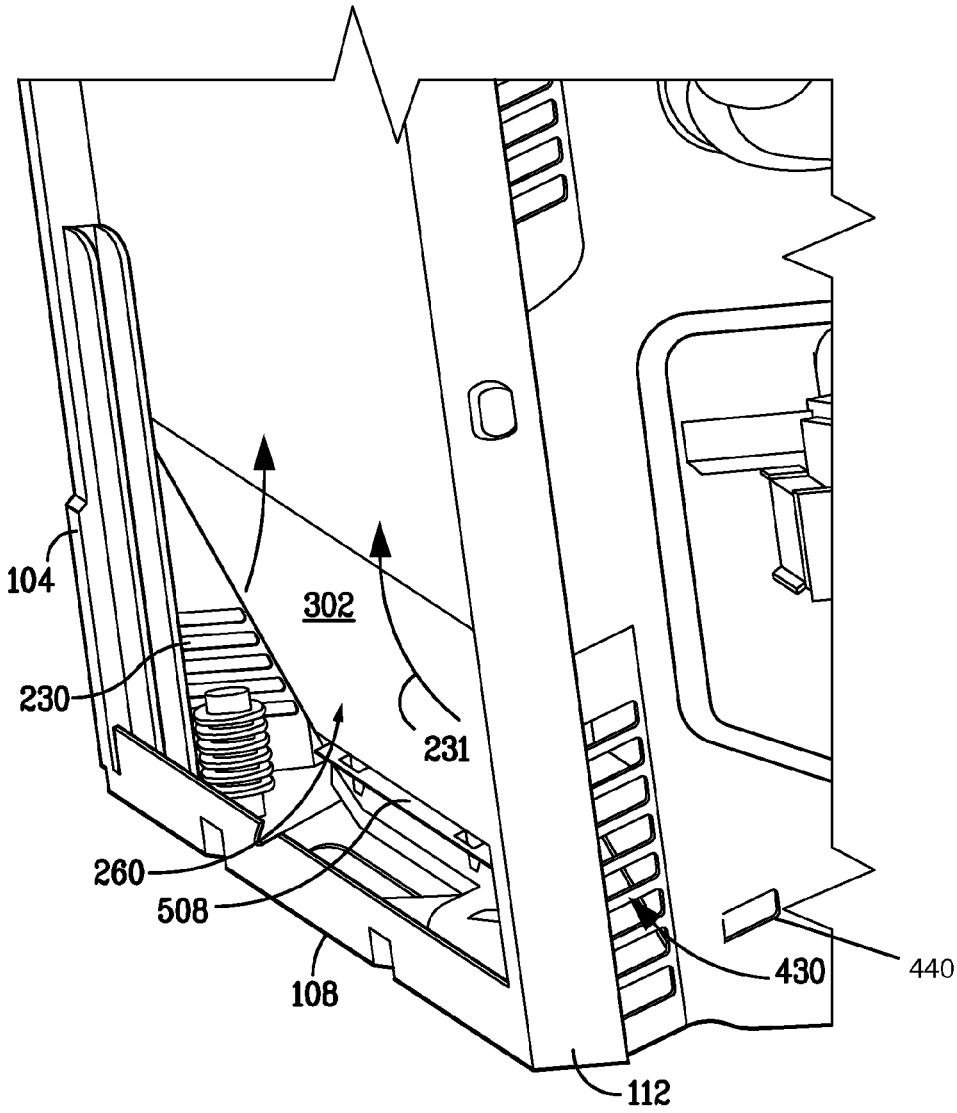
FIG. 4 is a rear, perspective view of an air inlet structure and barrier member for a cooking appliance incorporating aspects of the disclosed embodiments.

As shown in FIG. 1, in one embodiment, the oven 100 includes one or more air inlets or openings 230 and 240, which each establish a pathway or passage for ambient airflow to enter the cabinet 102. Air inlets 230, 240, also referred to as first and second air inlets, are arranged on the front portion 104 of the cabinet 102, adjacent to the base portion 108. As is shown in FIGS. 3 and 4 for example, the air inlets 230, 240 take the form of louvers that are stamped out of the front portion 104. In alternate embodiments, the air inlets 230, 240 can take any suitable form for providing an airflow entry point for the ambient air needed for combustion and cooling. As is shown in FIGS. 2 and 4, air inlet 230 can have a corresponding air inlet 430 on the back portion 112 of the cabinet 102, while air inlet 240 could also have a corresponding air inlet on the back portion 112 of the cabinet 102. The air inlets 430, 440 on the back portion 112 being referred to as third and fourth air inlets, respectively.

Referring to FIG. 2, the air inlet 230 provides an opening for airflow 231 into passageway 260. In one embodiment, passageway 260 is generally defined between the side and top portions 106, 110 of the cabinet 102, the outer side and top portions of the lower oven cavity 228 and the outer surfaces of the upper oven cavity 226. A portion of airflow 231 in the passageway 260 provides combustion airflow 232 to the upper cavity 226, while another portion of the airflow 231 provides cooling airflow 234 to the cabinet 102. In an embodiment that includes air inlet 430, the intake of ambient air into the air inlet 430 can be similar apportioned between combustion airflow to the upper cavity 226 and cooling airflow for the cabinet 102.

Passageway 270 is generally defined between the base portion 108 of the cabinet 102 and the external surface of the bottom 208 of the lower cavity 228, as will be further described herein. Air inlet 240 provides an opening for ambient air to flow into the passageway 270 for providing the combustion airflow 242 to the lower cavity 228. Passageway 270 is physically separated from passageway 260. It is a feature of the disclosed embodiments to physically separate the two passageways 260, 270 to isolate the lower combustion airflow 242 from the cooling and upper combustion airflow 231.

Referring to FIGS. 3 and 4, in order to separate passageways 260, 270 and isolate the air flows 231, 242 from each other, a barrier member 302 is provided between the air inlets 230, 240 and passageways 260, 270. As shown in FIG. 4, in one embodiment, the barrier member 302 extends from the front portion 104 to the back portion 112 of the cabinet 102, and upwards from the base portion 108 of the cabinet 102. The barrier member 302 is generally configured to close off either side of an area between the base portion 108 of the cabinet 102 and the bottom 208 of the lower cavity 228 to form passageway 270, an example of which is shown in FIG. 5. An outer side of the barrier member 302 forms a wall of the passageway 260, while the interior side of the barrier member 302 forms a wall of the passageway 270. In one embodiment, the barrier member 302 can be formed as an extension of part of the outer surfaces of the lower oven cavity 228, such as part of sidewall 206 or bottom 228. In another embodiment, the barrier member 302 can be a separate member that is configured to be secured within the cabinet 102 to form sides for the area between the base portion 108 of the cabinet 102 and the bottom 208 of the lower cavity 228. For example, the barrier member 302 can be attached to an external surface of the lower oven cavity 228 in a suitable fashion and extend downward to the base portion 108 of the cabinet 102. The barrier member 302 provides a physical separation between the passageways 260, 270, and thus isolates air flow 231 from air flow 242.

FIG. 5 illustrates a rear cross-sectional view of an exemplary oven 100 incorporating aspects of the disclosed embodiments. In this embodiment, the barrier member 302 is formed from the side insulation retainer 502. As is shown in FIG. 5, insulation blanket 504 extends about the exterior and side portions of the lower oven cavity 228. A similar insulation blanket 514 extends about the exterior and side portions of the upper oven cavity 226. In the embodiment shown in FIG. 5, the side insulation retainer 502 retains the insulation blanket 504 in close proximity to the outer sidewall 506 of the lower oven cavity 228. Similarly, the insulation blanket 514 is retained in close proximity to the outer sidewall 516 of the upper oven cavity 226. Each end 508 of the side insulation retainer 502 is configured to extend to the base portion 108 of the cabinet 102 to form the barrier member 302. Although the barrier member 302 as shown in FIGS. 4 and 5 is contiguous with the side insulation retainer 502, in alternate embodiments, the barrier member 302 can comprises a separate member that is suitably attached to the end 508 of the side insulation retainer 502. The barrier member 302 can also extend from the side insulation retainer 502 in any suitable orientation. For example, as shown in FIG. 4, in one embodiment, the barrier member 302 is angled from the end 508 of the insulation retainer 502 towards the base portion 108 in order to maintain a suitably sized opening behind the air inlet 230 into, or as part of the passageway 260. In alternate embodiments, the barrier member 302 can be angled to a greater or lesser degree relative to the base portion 108, depending for example on a size and location of the air inlet 230.

As shown in FIG. 5, first passageway 260 is generally defined between the sidewalls 106, the external surfaces of the oven cavities 226, 228 including insulation retaining members 502, 512 and the barrier member 302. The second passageway 270 is generally defined within the area confined by the barrier members 302, the base portion 108 of the cabinet 102 and the external surface of the bottom 208 of lower oven cavity 228.

Referring to FIG. 2, the air inlet 230 provides an opening for airflow 231 into passageway 260. In one embodiment, passageway 260 is generally defined between the side and top portions 106, 110 of the cabinet 102, the outer side and top portions of the lower oven cavity 228 and the outer surfaces of the upper oven cavity 226. A portion of airflow 231 in the passageway 260 provides combustion airflow 232 to the upper cavity 226, while another portion of the airflow 231 provides cooling airflow 234 to the cabinet 102. In an embodiment that includes air inlets on the back portion 112, such as third air inlet 430 shown in FIG. 4, the intake of ambient air into the third air inlet 430 can be similar apportioned between combustion airflow to the upper cavity 226 and cooling airflow for the cabinet 102.

Referring to FIG. 5, the airstream 231 enters the first passageway 260 from the air inlet 230. The airstream 231 travels up the side panel 106 towards the upper oven cavity 226. As airstream 231 travels upward, the side panel 106 is cooled through a convection heat transfer process. Once the air stream 231 reaches the approximate area of the upper oven cavity 226, a portion 232 supplies combustion air to the burner assembly 510 in a suitable manner. Another portion 234 of the air stream 231 continues upward along the side panel 106 towards the top portion 110 to provide cooling air for the upper oven cavity.

Air stream 242 enters the second passageway 270 from the air inlet 240. The air stream 242 supplies combustion air to the burner assembly 520 of the lower cavity 228.

Figure 6:
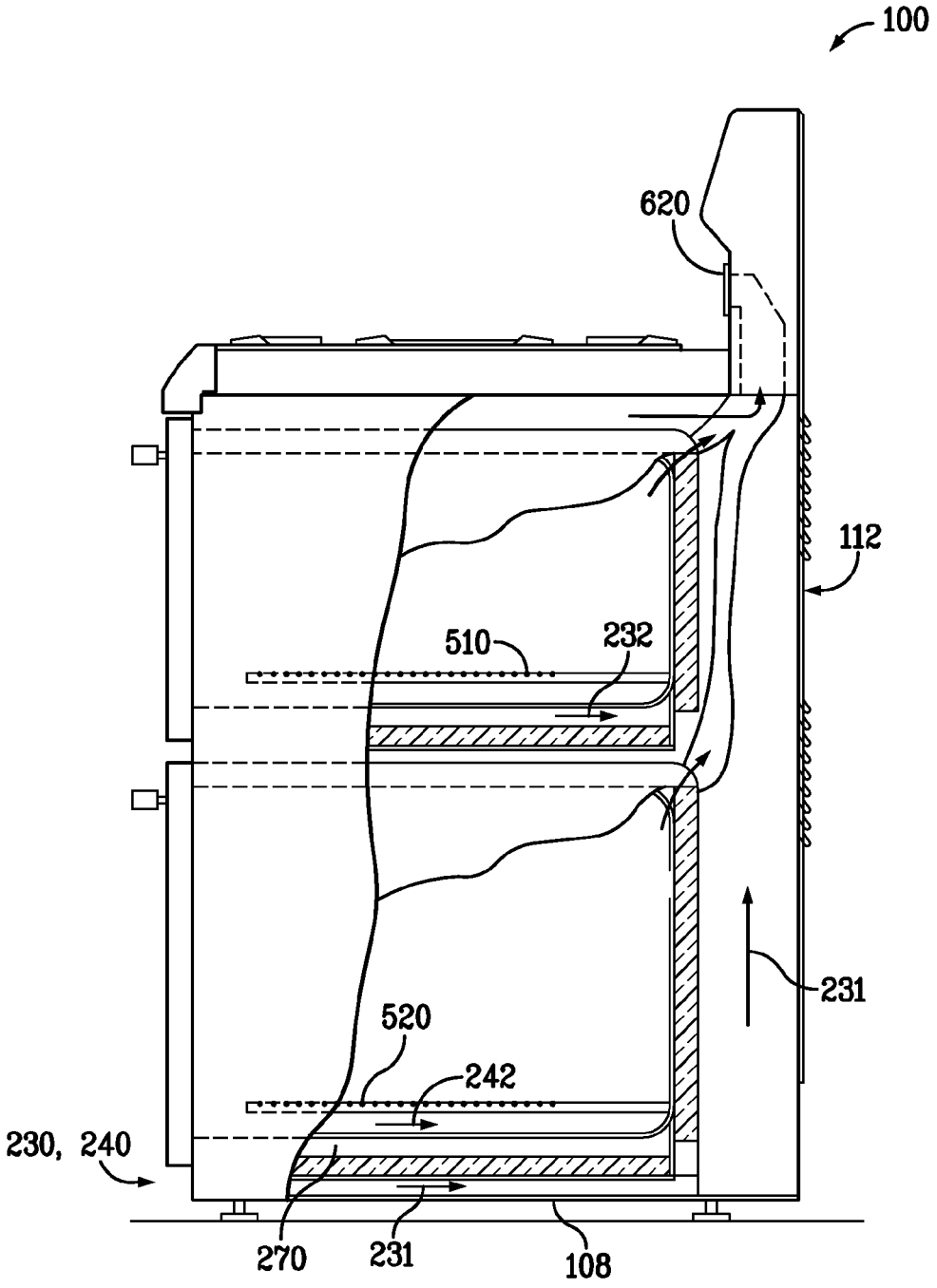
FIG. 6 is a cross-sectional side view of the cooking appliance of FIG. 1.

FIG. 6 illustrates a side cross-sectional view of the oven 100 of FIG. 1. The air inlet 230 provides airflow 231 in the first passageway 260 to provide combustion air 232 for the burner assembly 510, as well as provide the cooling air 234. The air inlet 240 provides airflow 242 in the second passageway 270 to feed the burner assembly 520 (FIG. 5). One or more vents 620 can be provided to allow the combustion and cooling air 231, 232, 234 and 242 to exit. The location and number of vents 620 shown in FIG. 6 is merely exemplary, and in alternate embodiments, any suitable number of vents 620 can be utilized in any suitable locations.

Figure 7:
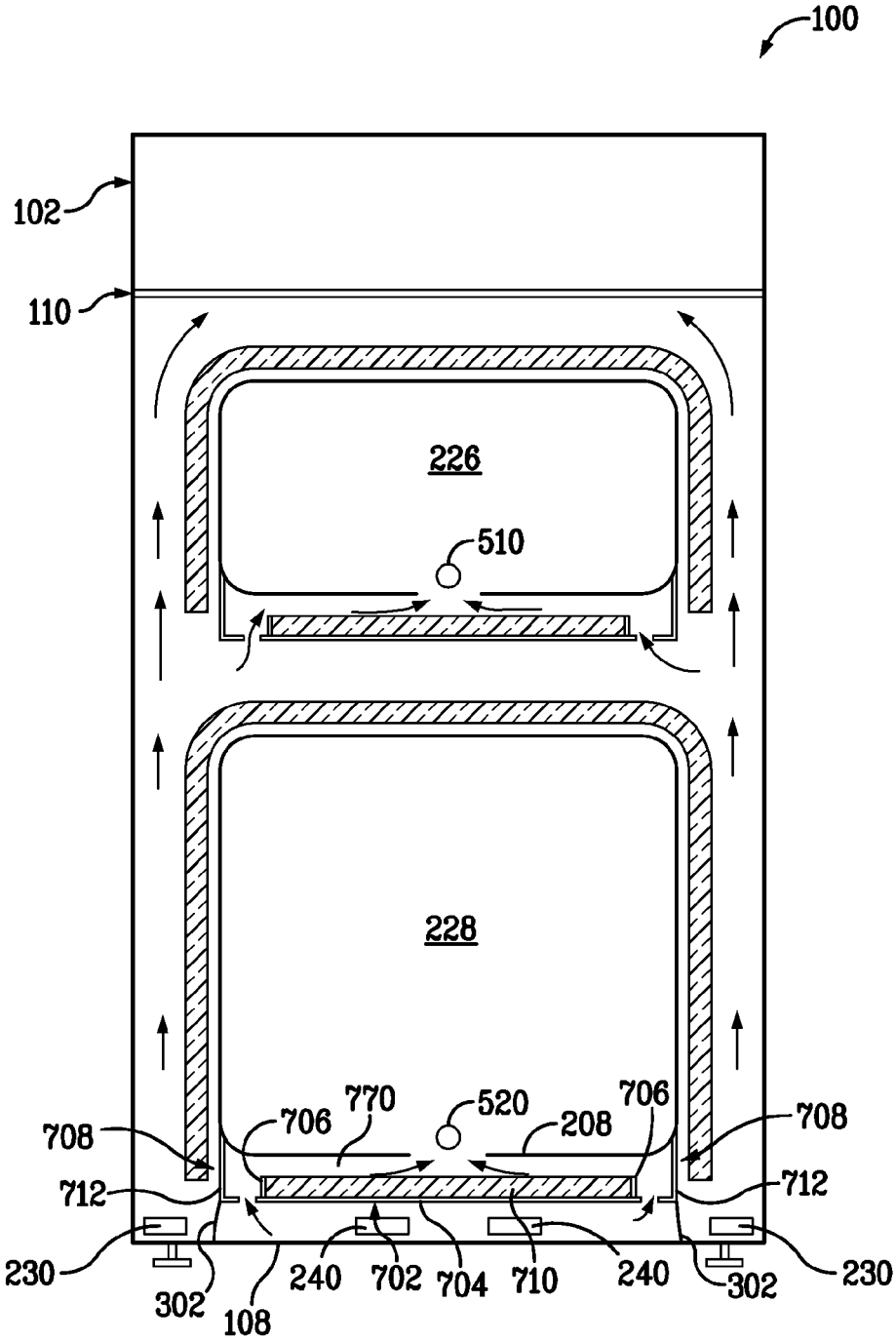
FIG. 7 is a rear, cross-sectional view of another embodiment of the cooking appliance of FIG. 1.

FIG. 7 illustrates another example of an oven 100 incorporating aspects of the disclosed embodiments. In this example, the barrier member 302 is formed as part of an upstanding side wall 708 of an insulation holder 702. As shown in FIG. 7, insulation holder 702 supports an insulation pad 710 below the lower oven cavity 228. The insulation holder 702 includes a base 704, a pair of upstanding inner sidewalls 706 and a pair of upstanding outer sidewalls 708. The inner sidewalls 706 confine the insulation pad 710 upon a central portion of base 704. The upstanding outer sidewalls 708 extend from the bottom portion 208 of the lower oven cavity 228 and maintain the insulation pad 710 a predetermined distance from the bottom wall 208 to form combustion air channel 770 between the insulation pad 710 and the bottom portion 208 of the lower oven cavity 228. The combustion air channel 770 is generally contiguous with the second passageway 270 and allows the airflow 242 to provide combustion air to the burner assembly 520. The barrier member 302 extends from a bottom portion 712 of each outer sidewall 708 to the base portion 108 of the cabinet 102. The orientation of the barrier members 302 relative to the outer sidewalls 708 can be straight or angled depending on the type and location of air inlet 230, 240 in the front portion 104.

The aspects of the disclosed embodiments are directed to improving the combustion and cooling airflow paths for gas double oven cooking products by isolating the lower oven combustion air from the cooling air and the upper over combustion air. A unique set of slots or air inlets in the base of the oven allow the two air paths to flow into the product. A barrier member between the slots and inside the oven isolates the two air paths.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cooking appliance comprising:

a cabinet including a front portion, opposing side panels, a base portion, a back panel and a top surface;

first and second oven cavities disposed within the cabinet, each of the first and second oven cavities including respective sidewall portions maintained in a spaced apart relationship from the opposing side panels;

a first airflow inlet to a first airflow passageway providing combustion air to the first oven cavity and cooling air within the cabinet, the first air inlet being disposed in an outer surface of the cabinet;

a second airflow inlet to a second airflow passageway providing combustion air to the second oven cavity, the second air inlet being disposed in the outer surface of the cabinet;

a barrier member fluidly separating the first airflow inlet and the first airflow passageway from the second airflow inlet and the second airflow passageway, the barrier member extending from the front portion to the back panel of the cabinet and upwards from the base portion of the cabinet.

2. The cooking appliance of claim 1, wherein the first airflow passageway is defined by an area comprised of each opposing side panel of the cabinet, outer top and side surfaces of the first oven cavity and the second oven cavity and the barrier member extending from the base portion of the cabinet that is spaced apart from each opposing side panel.

3. The cooking appliance of claim 1, wherein the second airflow passageway is defined by an area comprised of the base portion of the cabinet, a bottom surface of the second oven cavity, and a barrier member on each side of the bottom surface of the second oven cavity extending to the base portion of the cabinet, each barrier member being in a spaced apart relationship from a respective opposing side panel of the cabinet.

4. The cooking appliance of claim 1, wherein:

the first airflow inlet is arranged along the front portion adjacent to the base portion, the first airflow inlet being configured to direct a first ambient airflow into the first passageway, whereupon a first portion of the first ambient airflow flows into the first oven cavity to supply combustion air to the first oven cavity, and a second portion of the first ambient airflow is a cooling airflow within the cabinet and the second airflow inlet is arranged along the front portion adjacent to the base portion, the second airflow inlet being configured to direct a second ambient airflow into the second passageway, the second ambient air flow flowing into the second oven cavity to supply combustion air to the second oven cavity.

5. The cooking appliance of claim 4, further comprising:

a third airflow inlet arranged along the back panel adjacent to the base portion, the third airflow inlet being configured to direct a third ambient airflow into the first passageway, whereupon a first portion of the third ambient airflow flows into the first oven cavity to supply combustion air to the first oven cavity, and a second portion of the third ambient airflow is a cooling airflow within the cabinet;

a fourth airflow inlet arranged along the back panel adjacent to the base portion, the fourth airflow inlet being configured to direct a fourth ambient airflow into the second passageway, the fourth ambient air flow flowing into the second oven cavity to supply combustion air to the second oven cavity.

6. The cooking appliance of claim 1, wherein the barrier member is a part of a side insulation retainer of the second oven cavity.

7. The cooking appliance of claim 1, wherein the cooking appliance is a gas double oven.

8. A cooking appliance comprising:

a cabinet including a front portion, opposing side panels, a base portion, a back panel and a top surface;

first and second oven cavities disposed within the cabinet, each of the first and second oven cavities including respective sidewall portions maintained in a spaced apart relationship from the opposing side panels;

a first airflow inlet in a surface of the cabinet to a first passageway defined between each opposing side panel and the respective sidewall portions of the first and second oven cavities and extending from the front portion to the back panel;

a second airflow inlet in the surface of the cabinet to a second passageway defined between the base portion and a bottom surface of the second oven cavity, and extending from the front portion to the back panel; and a barrier member spaced apart from an inner sidewall of the side panel of the cabinet and extending from the front portion to the back panel and upwards from the base portion, the barrier member fluidly separating the second airflow inlet and the second passageway from the first airflow inlet and the first passageway.

9. The cooking appliance of claim 8, wherein:

the first airflow inlet is arranged along the front portion adjacent to the base portion, the first airflow inlet being configured to direct a first ambient airflow into the first passageway, whereupon a first portion of the first ambient airflow flows into the first oven cavity to supply combustion air to the first oven cavity, and a second portion of the first ambient airflow is a cooling airflow within the cabinet and the second airflow inlet is arranged along the front portion adjacent to the base portion, the second airflow inlet being configured to direct a second ambient airflow into the second passageway, the second ambient air flow flowing into the second oven cavity to supply combustion air to the second oven cavity.

10. The cooking appliance of claim 9, further comprising:

a third airflow inlet arranged along the back panel adjacent to the base portion, the third airflow inlet being configured to direct a third ambient airflow into the first passageway, whereupon a first portion of the third ambient airflow flows into the first oven cavity to supply combustion air to the first oven cavity, and a second portion of the third ambient airflow is a cooling airflow within the cabinet;

a fourth airflow inlet arranged along the back panel adjacent to the base portion, the fourth airflow inlet being configured to direct a fourth ambient airflow into the second passageway, the fourth ambient air flow flowing into the second oven cavity to supply combustion air to the second oven cavity.

11. The cooking appliance of claim 10, wherein the barrier member separates the third airflow inlet from the fourth airflow inlet.

12. The cooking appliance of claim 8, wherein the barrier member is configured to separate an area defined between the bottom surface of the second oven cavity and the base portion of the cabinet from an area defined between each opposing side panel and the respective sidewall portions of the first and second oven cavities.

13. The cooking appliance of claim 8, wherein the barrier member is a part of a side insulation retainer of the second oven cavity.

14. The cooking appliance of claim 8, wherein the first passageway provides combustion air for the first oven cavity and cooling air for the cabinet, and the second passageway provides combustion air for the second oven cavity.

15. The cooking appliance of claim 8, wherein the cooking appliance comprises a double gas oven.

* * * * *